United States Patent [19]

Snow

[11] 3,952,562

[45] Apr. 27, 1976

[54] COMBINED KNOB AND PERMUTATION LOCK ASSEMBLY FOR DOOR LATCHES

[76] Inventor: A. Ray Snow, 1327 S. 14th East, Salt Lake City, Utah 84105

[22] Filed: June 9, 1975

[21] Appl. No.: 585,313

[52] U.S. Cl. ..... 70/146; 70/213; 70/303 R; 70/316; 70/324

[51] Int. Cl.[2] ..... E05B 13/10; E05B 37/08

[58] Field of Search ..... 70/146, 147, 156, 213, 70/302, 303, 324

[56] References Cited

UNITED STATES PATENTS

| | | | |
|---|---|---|---|
| 1,022,268 | 4/1912 | Schechter | 70/303 R |
| 1,217,802 | 2/1917 | Mattice | 70/213 |
| 1,898,947 | 2/1933 | Frey | 70/312 |
| 3,064,463 | 11/1962 | Johnson | 70/156 |

*Primary Examiner*—Albert G. Craig, Jr.

*Attorney, Agent, or Firm*—Philip M. Hinderstein

[57] ABSTRACT

A permutation lock assembly incorporated into a door knob and latch mechanism mountable in the standard openings in conventional swinging doors, using conventional door latch hardware. Rotation of an outer dial in a first direction causes rotation of an inner dial which is visible through a window until a number on the inner dial appears at the center of the window. Upon rotation of the outer dial in an opposite direction until a number thereon is aligned with a center mark, the door is unlocked and may be readily opened. When the proper combination is known, the combination may be changed, within a few seconds, from one combination to another. Also incorporated is a clutch device in the external knob that permits the knob to turn in either direction when the door is locked and excessive force is applied, thus preventing damage to the assembly.

19 Claims, 15 Drawing Figures

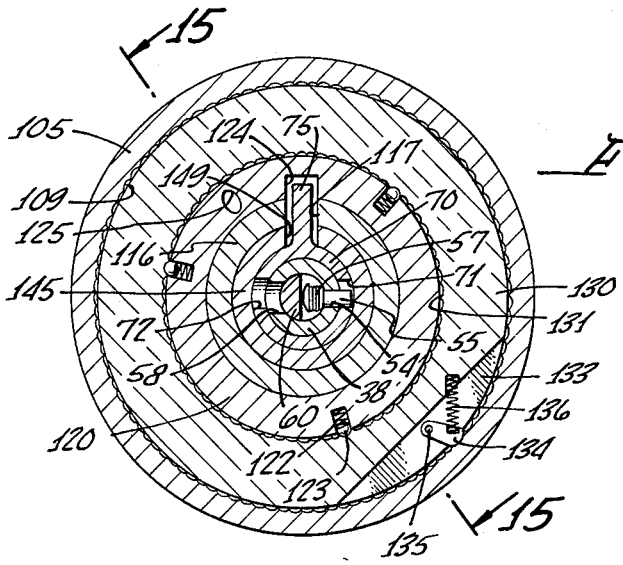
FIG. 14.
FIG. 15.
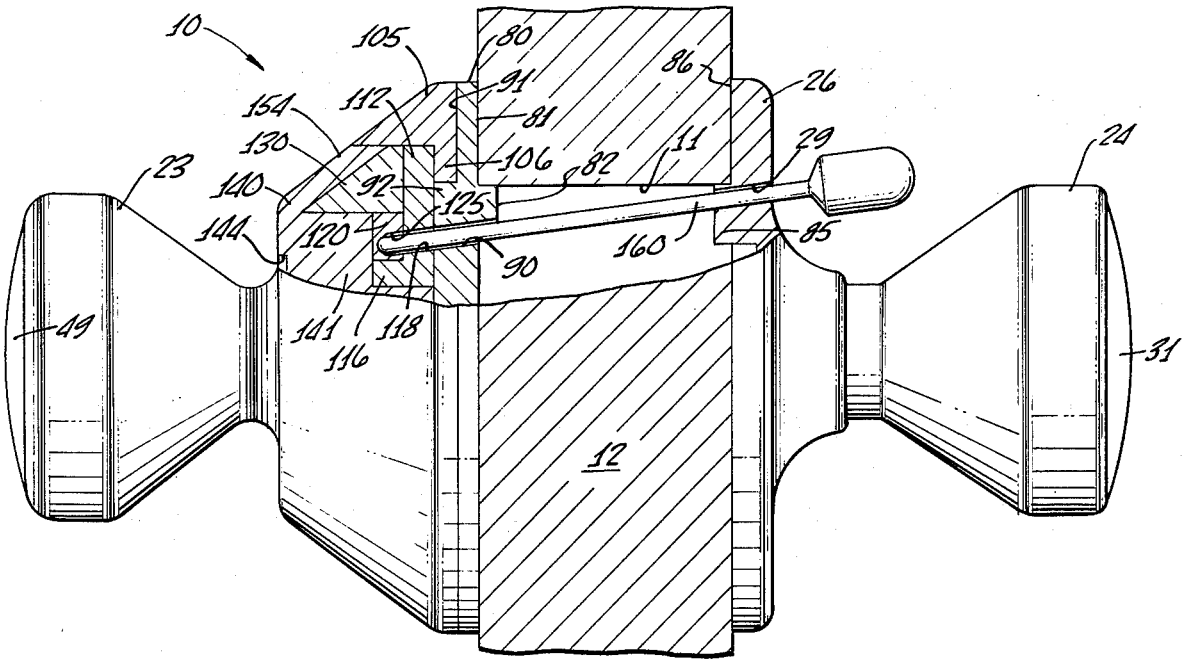

COMBINED KNOB AND PERMUTATION LOCK ASSEMBLY FOR DOOR LATCHES

BACKGROUND OF THE INVENTION

1. Field of the Invention

The present invention relates to a combined knob and permutation lock assembly for door latches and, more particularly, to a permutation lock assembly designed to fit conventional swinging doors to provide maximum security without the need of a key which could be lost, stolen, or duplicated.

2. Description of the Prior Art

Conventional swinging doors typically include a combined knob and key lock assembly for activating the door latch. Such combined knob and key lock assemblies are readily installed in a door by drilling a single circular hole through the door and by drilling a second hole perpendicular to the first hole for the latch assembly. Thus, such a construction is readily securable to a door and provides a reasonable degree of security, under normal circumstances.

The main problem with such a combined knob and key lock assembly is the need for a key to unlock the door from the outside thereof. Such keys can be lost, stolen, or duplicated, and the keyhole presents an opening for tampering with the lock mechanism. If the key is lost or stolen, the procedure for changing the combination typically requires the intervention of a skilled locksmith and the high cost associated therewith.

One common approach to solving the problem of lost keys for locks in general is the use of a permutation-type lock assembly. With a permutation-type lock, keys may be eliminated, thereby eliminating the problems associated with the loss thereof. However, while permutation-type locks are generally well known, they are not generally known for use in combination with a door knob to operate a door latch.

U.S. Pat. Nos. 724,774; 1,076,171; 1,217,802; 1,287,435; 1,554,270; 1,816,575; and 2,836,052 disclose permutation lock assemblies for use with a swinging door. However, all of such mechanisms have at least one of several problems associated therewith. In some of these mechanisms, the entire lock assembly is external to the door where it is unattractive and readily available for tampering or destruction. Others of said mechanisms require substantial modification to the normal door apertures or the addition of separate and distinct locking elements different from the conventional door latch. Heretofore, it has been unknown to provide a combined knob and permutation lock assembly designed to fit conventional swinging doors without any modification thereto for use with conventional door latches to provide maximum security without the need of a key which could be lost, stolen, or duplicated.

SUMMARY OF THE INVENTION

According to the present invention, there is provided a combined knob and permutation lock assembly for door latches which is designed to fit conventional swinging doors to provide maximum security without the need of a key which could be lost, stolen, or duplicated. With the present assembly, there is no need to prepare the door beyond the normally drilled openings for conventional hardware. Once installed, the external door knob was positioned adjacent thereto a coaxial cone which can be rotated first in one direction and then in another direction to dial a desired combination. A minimum of 3,540 combinations are available. Furthermore, the present assembly permits the operator, when the proper combination is known, to change, within a matter of seconds, from one combination to another, thereby eliminating the expensive re-keying process normally associated with key-activated locks.

When the present door is locked, the knob can not be turned and the door latch will not retract. On the other hand, a clutch device in the external knob permits the knob to turn in either direction when the door is locked and excessive force is applied thereto, thus preventing damage to the present assembly.

The present assembly offers outstanding visibility of the dial characters with the main dial on a two-dial mechanism controlling a secondary, hidden dial. Thus, the door can be programed to open very rapidly with the use of one hand rotating the main dial in one direction, which rotates the inner dial, which is visible through a magnifying lens. Then, by rotating the main dial in the other direction to the proper number, the door is unlocked. Locking the door knob is achieved by simply rotating through an angle of 90° a dial mounted within the internal knob.

Briefly, the present combined knob and permutation lock assembly for door latches comprises coaxial external and internal knobs mounted for rotation on opposite sides of a door; a composite shaft extending coaxially between the door knobs for rotation therewith, the shaft engaging and activating the door latch upon rotation thereof by either of the knobs; a sleeve mounted on the shaft for axial movement only relative thereto, the sleeve having a diagonal slot therein and including a radially extending key; a pin mounted within the shaft and being movable axially relative thereto, perpendicular to the axis of the shaft, through a hole therein, into and out of the slot in the sleeve, the shaft being rotatable independently of the sleeve to activate the door latch when the pin is withdrawn from the slot in the sleeve, rotation of the shaft causing axial movement of the sleeve when the pin is extending into the slot therein; means for biasing the pin out of the slot in the sleeve; cam means manually operable from a point adjacent the internal knob for moving the pin into the slot in the sleeve to thereby lock the door; first and second coplanar locking rings mounted coaxially with the shaft, the locking rings having first and second slots therein, respectively, which are alignable with the sleeve key, the locking rings preventing axial movement of the sleeve and thereby preventing rotation of the shaft and activation of the door latch, except when both the first and second slots are aligned with the sleeve key; and means mounted coaxially with and adjacent the external door knob and operatively connected to the first and second locking rings for independently moving the locking rings to unlock the assembly. The means for moving the locking rings comprises outer and inner concentric dials mounted adjacent the external door knob and having indicia on the outwardly directed faces thereof; means interconnecting the dials for rotation of the inner dial with the outer dial in a first rotary direction only; and means operatively connecting the first and second locking rings to the outer and inner dials, respectively, for rotation therewith, the outer dial being rotatable in the first direction to align the inner dial and the slot in the second locking ring with the sleeve key, the outer dial then being rotatable in an opposite rotary direction to align the slot in the first locking ring with the sleeve key, the inner dial and the second locking ring remaining stationary during rotation of the outer dial and the first locking ring in the opposite direction.

OBJECTS

It is therefore an object of the present invention to provide a combined knob and permutation lock assembly for door latches.

It is a further object of the present invention to provide a permutation lock assembly designed to fit conventional swinging doors to provide maximum security without the need of a key which could be lost, stolen, or duplicated.

It is a still further object of the present invention to provide a combined knob and permutation lock assembly for door latches which requires no additional preparation to a door beyond the normally drilled openings for conventional hardware.

It is another object of the present invention to provide a combined knob and permutation lock assembly for door latches in which the combination may be readily changed.

It is still another object of the present invention to provide a combined knob and permutation lock assembly for door latches incorporating a clutch device in the external knob that permits the knob to turn in either direction when the door is locked and excessive force is applied, thus preventing damage to the assembly.

Another object of the present invention is the provision of a combined knob and permutation lock assembly for door latches in which the combination is selected by rotation of a single dial mounted coaxially with an external door knob.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

BRIEF DESCRIPTION OF THE DRAWINGS

FIG. 14 is a sectional view taken along the line 14—14 in FIG. 13; and

FIG. 15 is a partial, sectional view taken along the line 15—15 in FIG. 14 showing the technique for changing the combination.

DESCRIPTION OF THE PREFERRED EMBODIMENT

Figures 1, 2, 4:
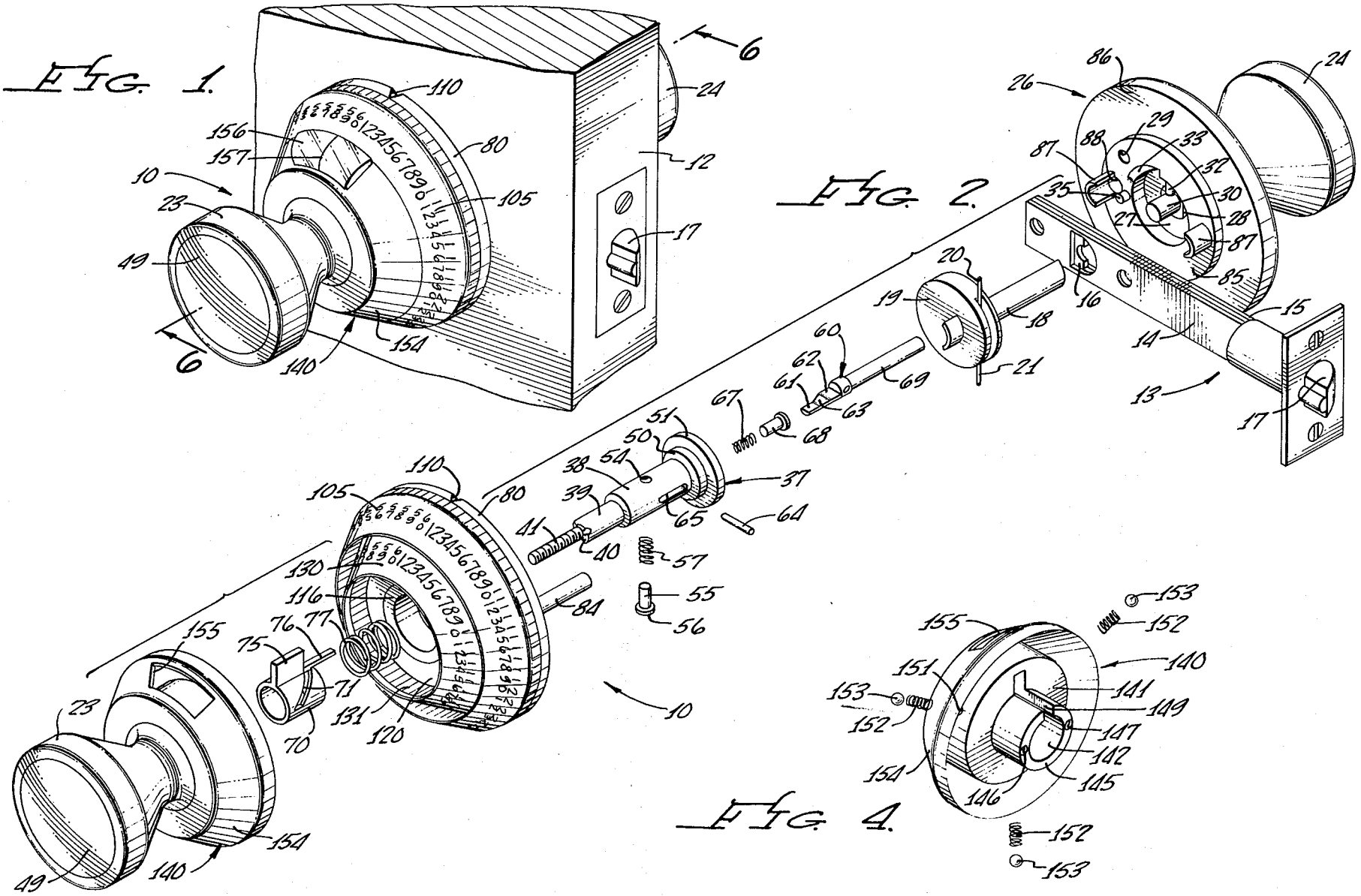
FIG. 1 is a perspective view of the present combined knob and permutation lock assembly for door latches as it appears connected to a conventional swinging door, using a conventional latch mechanism.
FIGS. 2, 3, and 5 are exploded, perspective views of portions of the assembly of FIG. 1.
FIG. 4 is a perspective view of the external rosette of the assembly of FIG. 1.
Figures 3, 5:
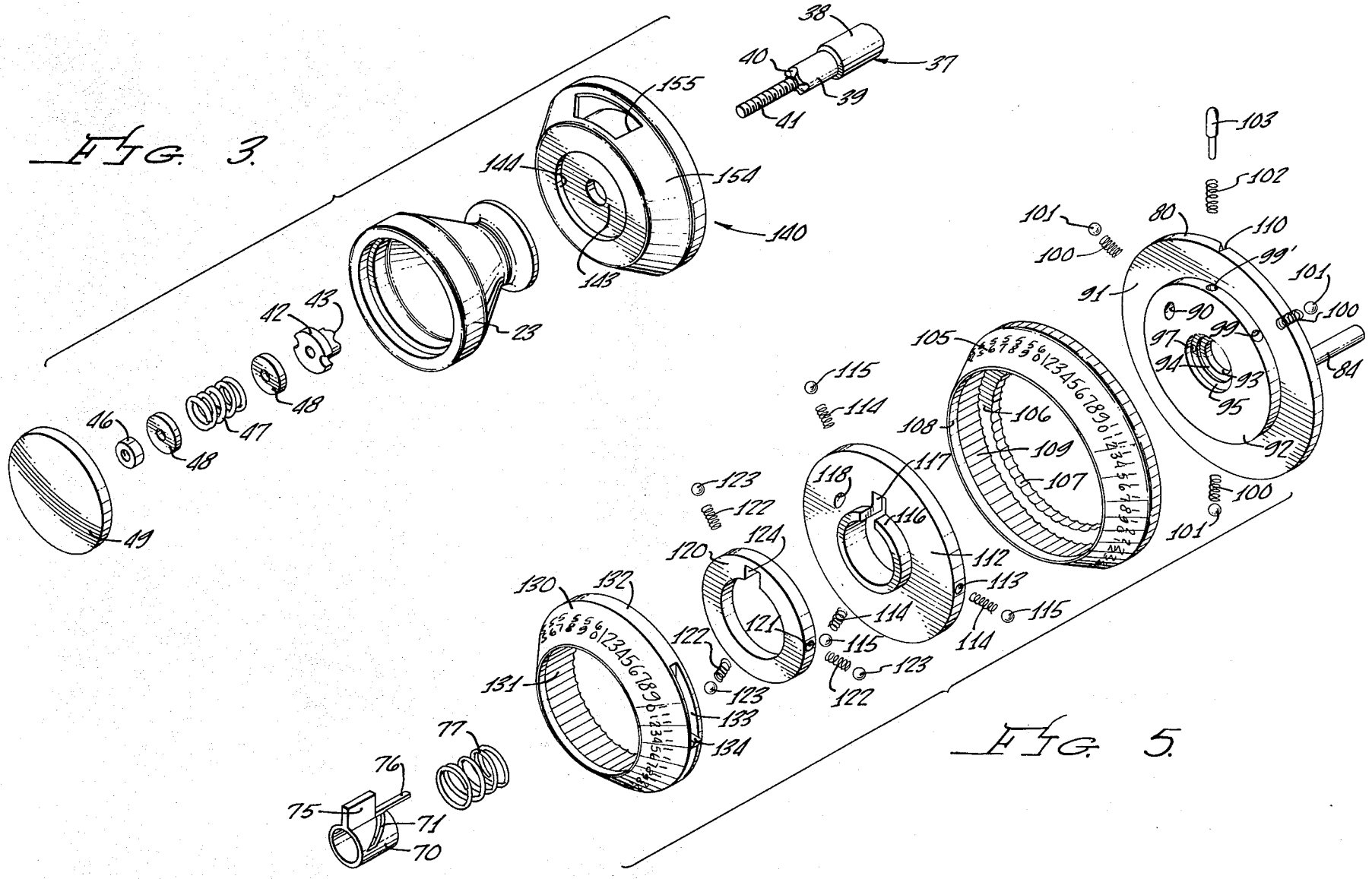

Referring now to the drawings and, more particularly, to FIGS. 1–10 and 12 thereof, the present combined knob and permutation lock assembly, generally designated 10, is designed for installation in a standard circular hole 11 in a conventional door 12 to operate a conventional latch mechanism 13. Latch mechanism 13 typically includes a pair of plates 14 and 15 in which is mounted a slide member 16, movement of which activates a latch tongue 17. Movement of slide member 16 is controlled by rotation of a shaft 18 having a generally C-shaped cross-section, extending through adjacent slots in plates 14 and 15 and slide member 16. Thus, rotation of shaft 18 in either direction causes one edge thereof to move slide member 16 to the left, as viewed in FIG. 2, retracting tongue 17.

Shaft 18 is connected to a housing 19 which contains a spring 22, the opposite ends 20 and 21 of which extend outwardly from housing 19. With ends 20 and 21 restrained, as described more fully hereinafter, spring 22 holds shaft 18 in its center position, as shown in FIG. 2, with tongue 17 extended. Thus, after rotation of shaft 18, as explained more fully hereinafter, by either of the door knobs and subsequent release thereof, spring 22 will return shaft 18 to its center position, extending tongue 17.

Assembly 10 includes external and internal knobs 23 and 24, respectively, which are adapted to be mounted in coaxial relationship on opposite sides of door 12. Both knobs 23 and 24 are of conventional, conical shape, both knobs being hollow to contain portions of the activating mechanisms of assembly 10. The inner end of knob 24 is externally threaded, at 25, and extends through a central opening in an internal rosette 26. Connection to internal rosette 26 is accomplished through an internally threaded ring 27, which is tightened onto knob 24 in such a manner as to permit the rotation of knob 24 relative to rosette 26. Furthermore, and as shown most clearly in FIG. 10, the inner end of knob 24 has an arcuate slot 28 in the end thereof for receipt of one end of shaft 18. Thus, rotation of knob 24 causes rotation of shaft 18 and activation of latch mechanism 13, as described previously.

Extending through the center of knob 24 is a shaft 30, one end of which is connected to a dial 31 positioned adjacent the external end of knob 24. Connected to the inner end of shaft 30 is a radially outwardly extending pin 32, the outer end of which engages a cam track 33 made integral with internal rosette 26. Thus, rotation of dial 31 and shaft 30 causes pin 32 to move along track 33, causing axial movement of shaft 30. With shaft 30 and dial 31 in the position shown in FIG. 6, dial 31 is in its position farthest from door 12. On the other hand, clockwise rotation of dial 31 through an angle of 90° causes inward movement of shaft 30 to the position shown in FIG. 11. Movement of dial 31 beyond 90° is prevented by a pin 35 connected to rosette 26, at the end of track 33. When dial 31 is returned to the position shown in FIG. 6, shaft 30 is moved outwardly by means of a spring 34 positioned between knob 24 and shaft 30. As will be explained more fully hereinafter, it is this rotation of dial 31 and axial movement of shaft 30 which is used to lock and unlock assembly 10 from the inside of door 12.

Assembly 10 includes a cam housing, generally designated 37, including a central, elongate, hollow section 38, one end of which is connected to one end of a solid, reduced diameter section 39, the other end of section 39 having a serrated face 40. Extending from the center of serrated face 40 is a reduced diameter, externally threaded section 41. Section 39 of housing 37 extends through the inner, hollow end of knob 23 with section 41 positioned within knob 23. Mounted on threaded section 41 is a clutch disc 42, one end of which has a serrated face 43 which mates with serrated face 40 of cam housing 37. Clutch disc 42 extends into a circular countersink 44 in the base of knob 23 and rotation therebetween is prevented by means of a pair of pins 45, shown in FIG. 12, which intersect the circumferences of disc 42 and countersink 44.

In order to maintain serrated faces 40 and 43 in contact, a nut 46 is mounted on the end of threaded section 41 of housing 37, a spring 47 and a pair of washers 48 at the opposite ends thereof being positioned between nut 46 and clutch disc 42. Accordingly, through the action of spring 47 forcing clutch disc 42 against cam housing 37, rotation of door knob 23 causes rotation of clutch disc 42, via pins 45, and rotation of cam housing 37. The open, outer end of knob 23 is enclosed, after assembly, by a disc 49 which is press-fitted therein.

Figure 6:
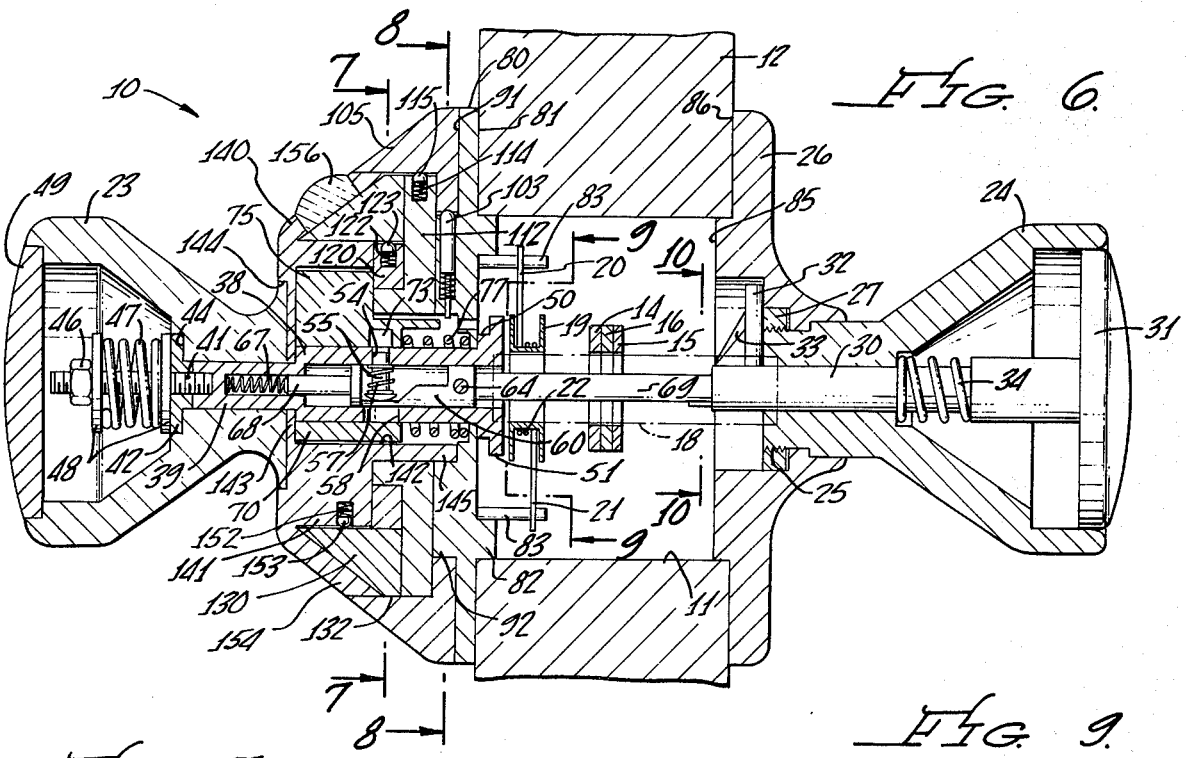
FIG. 6 is a longitudinal, sectional view through the assembly of FIG. 1, taken in a vertical plane, with the lock assembly unlocked.
Figure 9:
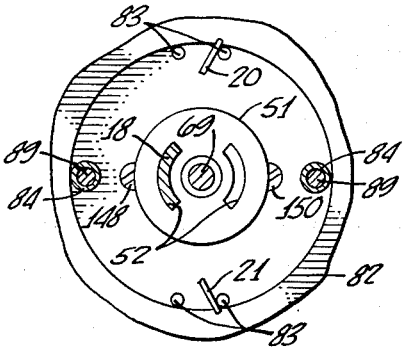
FIG. 9 is a sectional view taken along the line 9—9 in FIG. 6.
Figure 10:
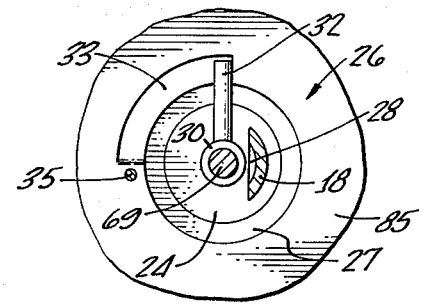
FIG. 10 is a sectional view taken along the line 10—10 in FIG. 6.

As shown most clearly in FIGS. 2, 6, and 9, the other end of central section 38 of cam housing 37 has a pair of collars 50 and 51 connected thereto, collar 50 having a diameter greater than central section 38, and collar 51 having a diameter greater than collar 50. In the face of collar 51, opposite to the face connected to collar 50, is a pair of generally C-shaped slots 52, one of which is adapted to receive one end of shaft 18, depending upon whether assembly 10 is positioned in a right or a left-hand door. Thus, housing 37 completes the connection between door knobs 23 and 24 in that one end of shaft 18 is connected in slot 28 in knob 24 for rotation therewith, and the other end of shaft 18 is connected in one of slots 52 in housing 37 which is connected to knob 23, as described previously. Thus, shaft 18 and housing 37 define a shaft means extending coaxially between knobs 23 and 24 for rotation therewith, such shaft means engaging and activating latch mechanism 13 upon rotation thereof by either of knobs 23 or 24.

Central section 38 has a transverse hole therein, in which is mounted a movable pin 55. The base of pin 55 has a head 56 and a spring 57 is positioned between head 56 and the inner wall of section 38, surrounding pin 55, to bias pin 55 downwardly, as viewed in FIG. 6. Pin 55 and spring 57 may be inserted into section 38 through a larger hole 58 in section 38, opposite hole 54. Once inserted into section 38, pin 55 and spring 57 are prevented from removal therefrom due to the insertion into section 38 of a slide member 60. slide member 60 is in the nature of a pin, one side of which is circular for contact with the cylindrical inner surface of section 38. The other side of slide member 60 has two flat surfaces 61 and 62 connected by a cam surface 63, head 56 of pin 55 being adapted to ride along surfaces 61-63. Slide member 60 moves axially through section 38 and is prevented from rotation therein and removal therefrom by a pin 64 which extends laterally therethrough and engages a pair of axial slots 65 on opposite sides of section 38 of housing 37.

Positioned within housing 37 is a spring 67 and a plunger 68 which are positioned between one end of slide member 60, adjacent surface 61, and section 39 of housing 37. Spring 67 and plunger 68 bias slide member 60 to the right, as viewed in FIG. 6. In this position, head 56 of pin 55 rests on surface 61, spring 57 retaining pin 55 in its retracted position so that the outer end thereof does not extend beyond the outer surface of central section 38 of housing 37. On the other hand, with slide member 60 moved to the left, as viewed in FIG. 6, to the position shown in FIG. 11, compressing spring 67, head 56 of pin 55 rides along cam surface 63 to come to rest on surface 62, compressing spring 57 and extending the end of pin 55 beyond the outer surface of central section 38 of housing 37.

Movement of slide member 60 is controlled by dial 31 and shaft 30. That is, slide member 60 has a shaft 69 made integral therewith which extends through housing 19 and shaft 18 and rests against the end of shaft 30. With dial 31 and shaft 30 in the position shown in FIG. 6, spring 67 and plunger 68 move slide member 60 to the position shown in FIG. 6, retracting pin 55. With dial 31 and shaft 30 moved to the position shown in FIG. 11, shaft 69 is simultaneously moved to the left, as viewed in FIG. 11, compressing spring 67 and spring 57 and extending pin 55.

Assembly 10 further includes a lock sleeve 70 mounted on section 38 of cam housing 37 for axial movement relative thereto. Lock sleeve 70 has a pair of intersecting, diagonal slots 71 and 72 in the surface thereof, the intersection 73 of slots 71 and 72 being positioned directly above hole 54 in section 38 of housing 37 when the component parts are in the position shown in FIG. 6. Thus, when slide member 60 is moved to the position shown in FIG. 11, the end of pin 55 extends into slots 71 and 72. Since sleeve 70 is prevented from rotating, in a manner to be described more fully hereinafter, rotation of cam housing 37 at this time will cause movement of sleeve 70 towards collars 50 and 51 at the end of housing 37, due to the interaction of pin 55 and slot 71 or 72. On the other hand, with pin 55 retracted to the position shown in FIG. 6, cam housing 37 can rotate totally independently of sleeve 70.

Lock sleeve 70 also includes a radially extending, generally rectangular, planar key 75, whose function will be described more fully hereinafter. Coplanar with key 75 and positioned above intersection 73 and extending beyond the forward end of lock sleeve 70 is a bridge member 76. Sleeve 70 is biased in the position shown in FIG. 6 by means of a spring 77, one end of which contacts sleeve 70.

Assembly 10 further includes a base plate 80, one side 81 of which is adapted to contact the outside of door 12, as shown in FIG. 6, side 81 of base plate 80 including a ring 82 which extends into hole 11 in door 12 and centers the entire assembly 10. Extending axially from ring 82 are two sets of pins 83 which retain spring ends 20 and 21 during rotation of housing 19. Also extending axially from ring 82 are a pair of internally threaded barrels 84 which extend through hole 11 in door 12, through holes in plates 14 and 15, and through slots in slide member 16, into contact with a corresponding ring 85 connected to side 86 of internal rosette 26. A pair of semicircular sleeves 87 connected to ring 85 surround the ends of barrels 84. A pair of holes 88 in internal rosette 26 are aligned with barrels 84. Thus, by extending a pair of bolts 89 through holes 88 in internal rosette 26 and into barrels 84, base plate 80 and internal rosette 26 are secured to opposite sides of door 12. All remaining components are connected either to internal rosette 26 or base plate 80.

The other side 91 of base plate 80 has a reduced diameter disc 92 connected thereto, base plate 80 having a hole 93 extending entirely therethrough. On side 91 of base plate 80 are first and second countersinks 94 and 95, countersink 94 receiving the other end of spring 77. A small hole 96 extends axially through base plate 80, in countersink 95, along a vertical plane passing through the axis of base plate 80, and a pair of holes 97 and 98 extend axially through base plate 80, in countersink 95, along a horizontal plane passing through the axis of base plate 80. Extending radially inwardly into disc 92, from the outer circumference thereof, are a plurality of spaced holes 99. Holes 99 extend only partially through disc 92 and receive springs 100 and ball bearings 101, as shown most clearly in FIG. 8. An additional hole 99', which is coplanar with hole 96, extends all the way to countersink 95 and receives a spring 102 and a lock pin 103. With the outer end of lock pin 103 tangent with the outer circumference of disc 92, the inner end thereof is positioned immediately above hole 96. The operation of lock pin 103 will appear more fully hereinafter.

Figure 8:
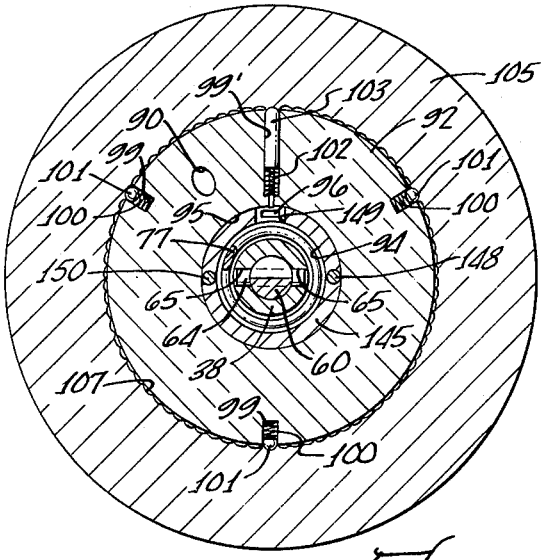
FIG. 8 is a sectional view taken along the line 8—8 in FIG. 6.

The permutation lock assembly portion of assembly 10 includes an outer dial cone 105, an inner dial cone 130 and locking rings 112 and 120. Outer dial cone 105 has a planar rear surface which contacts side 91 of base plate 80, surrounding disc 92. The rear portion 106 of dial cone 105 has an internal diameter which is slightly larger than the diameter of disc 92 and has a serrated internal surface 107. As shown in FIG. 8, balls 101 contact serrations 107, causing cone 105 to assume one of a fixed number of positions defined by serrations 107. Balls 101 also cause a clicking sound as dial cone 105 is rotated relative to base plate 80.

The forward portion 108 of dial cone 105 has a greater inside diameter than portion 106 and has a serrated internal surface 109. Appearing on the outer surface of dial cone 105 are a plurality of numbers, one for each of serrations 107 and 109. In the present example, there are sixty serrations 107 and 109 and sixty equally-spaced numbers, from 1 to 60, around the outside of dial cone 105. The desired number on dial cone 105 may be selected by means of a mark 110 on the outer surface of base plate 80.

Locking ring 112 has a plurality of radially inwardly extending holes 113 in the circumference thereof, each of holes 113 receiving a spring 114 and a ball 115. The outer diameter of locking ring 112 is slightly less than the inner diameter of portion 108 of dial cone 105, and locking ring 112 is positioned coaxially therewith so that balls 115 engage serrations 109. Locking ring 112 also has a reduced diameter collar 116 extending from the side thereof, opposite from the side contacting portion 106 of dial cone 105. A radially extending, generally rectangular, slot 117 extends through collar 116 and partially into locking ring 112.

Locking ring 120 has an inside diameter approximately equal to the outer diameter of collar 116, a thickness equal to the thickness of collar 116, and an outer diameter which is less than the outer diameter of locking ring 112. Locking ring 120 also has a plurality of radially inwardly extending holes 121 in the circumference thereof, each of holes 121 receiving a spring 122 and a ball 123. Locking ring 120 also has a radially extending, generally rectangular, slot 124 therein, slot 124 being adapted to be aligned with slot 117 in collar 116 and having a depth equal to the depth of the slot in locking ring 112.

Inner dial cone 130 has an inside diameter which is slightly greater than the outside diameter of locking ring 120 and serrated internal surface 131. Inner dial one 130 is adapted to be mounted coaxially with outer dial cone 105, with the rear surface thereof engaging one face of locking ring 112 and with balls 123 in locking ring 120 extending into serrations 131. The outwardly directed face of inner dial cone 130 has a plurality of numbers thereon, one for each of serrations 131. In the present example, there are sixty serrations in dial cone 130 and the numbers 1 through 60 appear on the outer face thereof.

While the major portion of the outer surface of dial cone 130 is conical, the rear end 132 is cylindrical and has a slot 133 therein. As shown most clearly in FIG. 7, slot 133 houses a ratchet mechanism including a pawl 134 mounted for rotation on a pin 135 and being biased by a spring 136. Spring 136 urges pawl 134 outwardly into contact with serrations 109 on the inner surface of portion 108 of dial cone 105. As dial cone 105 is rotated in a clockwise direction, as viewed in FIG. 7, pawl 134 is held in serrations 109, causing inner dial cone 130 to rotate with outer dial cone 105. On the other hand, when outer dial cone 105 is rotated in a counterclockwise direction, as viewed in FIG. 7, spring 136 compresses, permitting pawl 134 to be retracted from serrations 109, skipping from serration to serration and permitting inner dial cone 130 to remain stationary during rotation of outer dial cone 105.

The last major component of assembly 10 is the external rosette 140. External rosette 140 includes a cylindrical section 141 having an axial hole 142 extending entirely therethrough, hole 142 terminating in a lip 143 and then a countersink 144 at one end thereof. Countersink 144 receives the inner end of knob 23, whereas lip 143 contains sleeve 70, which is movable through hole 142, and the lip at the intersection between portions 38 and 39 of cam housing 37, which is rotatable in hole 142. Extending from the other end of cylindrical section 141 of external rosette 140 is a sleeve 145 which has an inside diameter equal to the inside diameter of hole 142 and an outside diameter which is slightly less than the inside diameter of locking ring 112. Sleeve 145 extends through locking ring 112 with the inner face of cylindrical section 141 contacting collar 116 and locking ring 120. The free end of sleeve 145 extends countersink 95 in base plate 80 and has a pair of internally threaded, axial holes 146 and 147 therein which align with holes 97 and 98, respectively, in base plate 80. Thus, by extending a pair of bolts 148 and 150 through holes 97 and 98, respectively, in base plate 80 and into threaded holes 146 and 147, respectively, in sleeve 145, external rosette 140 is rigidly connected to base plate 80.

Figure 13:
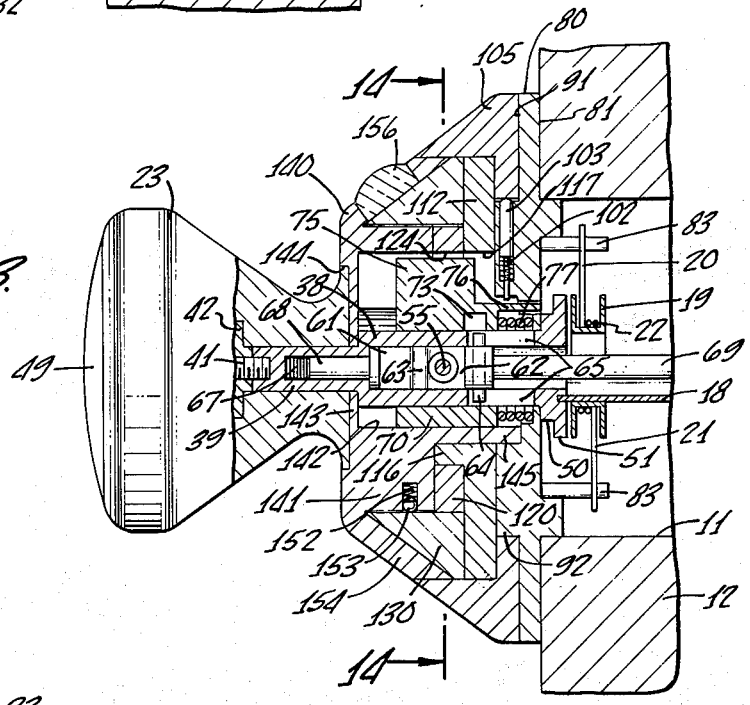
FIG. 13 is a partial, sectional view like FIG. 11 after the proper combination has been selected and the door knob has been rotated through an angle of 90°.
Figure 12:
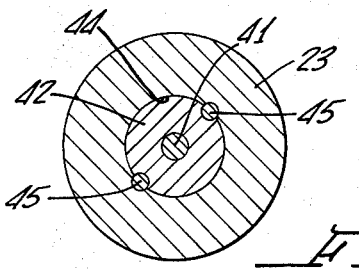
FIG. 12 is a sectional view taken along the line 12—12 in FIG. 11.

As stated previously, lock sleeve 70 is contained within sleeve 145 of external rosette 140 and moves therethrough between the positions shown in FIGS. 6 and 13, as will be described more fully hereinafter. Sleeve 145 has a slot 149 in the top thereof that extends for the entire length thereof for receipt of key 75 of lock sleeve 70. Slot 149 also extends partially into cylindrical section 141, again to receive key 75. The outer circumference of cylindrical section 141 of rosette 140 has a plurality of radially inwardly extending holes 151 therein, each hole 151 receiving a spring 152 and a ball 153, balls 153 engaging serrations 131 of inner dial cone 130.

External rosette 140 includes a hollow, conical section 154 which extends from the end of cylindrical section 141 adjacent countersink 144. The outer surface of conical section 154 represents an extension of the outer surface of outer dial cone 105, and the inner surface has dimensions approximately equal to the outer conical surface of inner dial cone 130. Conical section 154 has a window 155 therein, through which the numbers on inner dial cone 130 may be viewed. A magnifying lens 156, mounted in window 155, may be used for enlargement of the numbers along inner dial cone 130. A hairline 157 on lens 156 may be used to locate a desired number on inner dial cone 130.

As part of the mechanism for changing the combination of the permutation mechanism of assembly 10, internal rosette 26, base plate 80, and locking ring 112 have alignable holes 29, 90, and 118 extending entirely therethrough, and locking ring 120 has an alignable hole 125 extending partially therethrough. A removable pin-key 160 is insertable through hole 29 in internal rosette 26 and through hole 90 in base plate 80, holes 29 and 90 always being aligned, and into holes 118 and 125 in locking rings 120 and 112, respectively, under certain circumstances, to be described more fully hereinafter.

OPERATION

Figure 7:
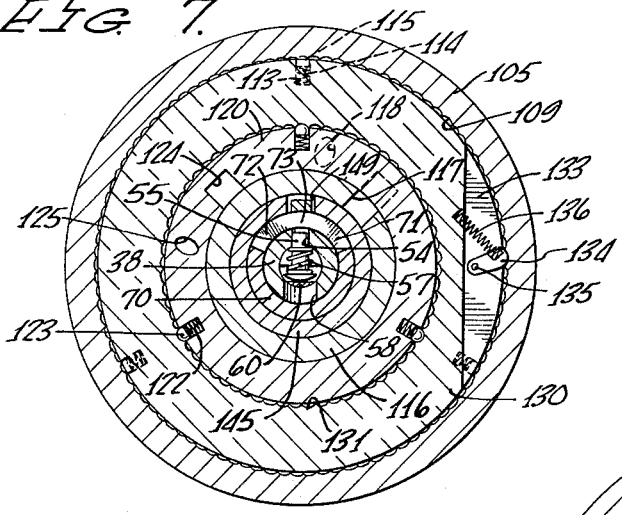
FIG. 7 is a sectional view taken along the line 7—7 in FIG. 6.

FIGS. 6, 7, and 8 show assembly 10 unlocked from the inside thereof. To unlock the door from the inside, plunger dial 31 is rotated counterclockwise, simultaneously traveling outwardly approximately ⅜ inches as it rotates 90°, pin 32 moving along cam track 33 and spring 34 moving shaft 30 to the right, as viewed in FIG. 6. As shaft 30 moves to the right, it permits spring 67 and plunger 68 to move slide member 60 in the same direction, due to the contact between shaft 69 and shaft 30. As slide member 60 travels with shafts 69 and 30, head 56 of pin 55 moves to surface 61 on slide member 60, spring 57 causing pin 55 to be withdrawn into housing 37.

With assembly 10 in this unlocked position, latch mechanism 13 can be manipulated to retract tongue 17 by turning either the external knob 23 or internal knob 24 in either direction. Rotation of external knob 23 rotates shaft 18 through the intermediary of cam housing 37, whereas internal knob 24 rotates shaft 18 directly.

Figure 11:
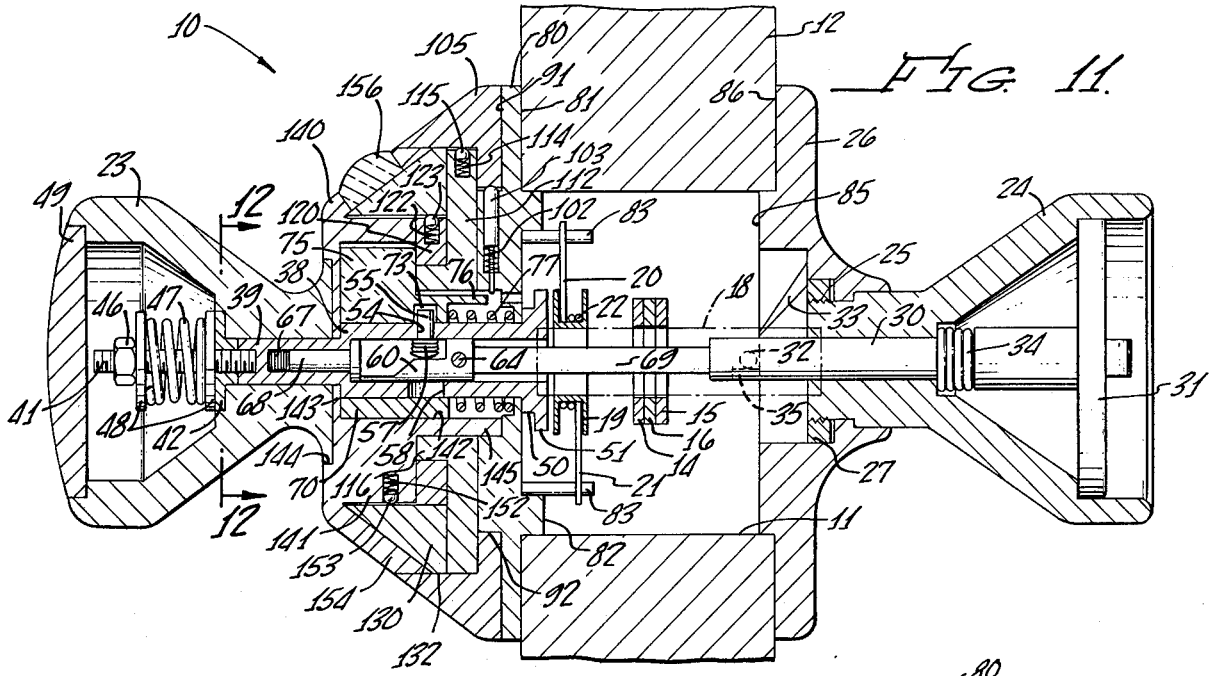
FIG. 11 is a sectional view similar to FIG. 6 with the lock assembly in the locked position.

Locking the door is accomplished by turning dial 31 mounted within internal door knob 24 in a clockwise direction through an angle of 90° to the position shown in FIG. 11. As dial 31 rotates, it travels inwardly as pin 32 travels along cam track 33. As shaft 30 moves inwardly, it forces shaft 69 and slide member 60 forwardly, causing head 56 of pin 55 to travel from surface 61 to surface 62 via cam surface 63. This action simultaneously compresses springs 57 and 67 and pin 54 now extends beyond the outer surface of section 38 of housing 37 into slots 71 and 72, at intersection 73, in lock sleeve 70. With lock assembly 10 in the above-described locked position and the assembly not programed to open, latch mechanism 13 cannot be operated. That is, external knob 23 is attached to cam slide housing 37 through the intermediary of pins 45 and clutch disc 42. As knob 23 turns, so does housing 37, thus biasing in an axially inward direction lock sleeve 70. If door 12 is not programed to open, this action will move lock sleeve key 75, which is attached securely to sleeve 70, flush against collar 116 of locking ring 112 and/or locking ring 120. Since lock sleeve 70 cannot move forwardly, cam housing 37 cannot rotate, preventing any further motion of door knob 23 and preventing activation of latch mechanism 13 and retraction of tongue 17.

Excessive pressure on external door knob 23 will allow knob 23 to rotate without retracting latch tongue 17 or permitting damage to be incurred to any part of assembly 10. This is accomplished through the attachment of clutch disc 42, which is mounted in knob 23. The serrated face 43 of clutch disc 42 meshes with the serrated face 40 at the end of section 39 of housing 37 and is held snugly in position by the pressure of spring 47. However, excessive pressure on knob 23 forces serrations 40 and 43 to slip passed each other, causing clutch disc 42 and knob 23 to retract axially relative to housing 37, compressing spring 47. This permits knob 23 and disc 42 to rotate without rotating housing 37.

With dial 31 in the position shown in FIG. 11 and mechanism 10 locked, latch mechanism 13 may be activated by selection of the proper combination as follows. Considering FIGS. 6, 7, and 8, rotation of outer dial cone 105 clockwise in turn forces the rotation of inner dial cone 130, due to the previously described interaction between pawl 134 and serrations 109 in dial cone 105. By looking at the indicia on inner dial cone 130 through lens 156, inner dial cone 130 may be rotated in a clockwise direction until the programed number comes in alignment with hairline 157 on lens 156. Simultaneously with the rotation of inner dial cone 130, locking ring 120 is being rotated. This occurs because balls 123 are held by springs 122 in serrations 131 of inner dial cone 130. Furthermore, when the programed number on inner dial cone 130 is in alignment with hairline 157, slot 124 in locking ring 120 is aligned with lock sleeve key 75.

Outer dial cone 105 may now be turned in a counterclockwise direction until the programed number appears in alignment with mark 110 at the top of base plate 80. When outer dial cone 105 is rotated in a counterclockwise direction, pawl 134 compresses spring 136, permitting inner dial cone 130 to remain stationary. Furthermore, springs 152 urge balls 153 in external rosette 140 into serrations 131 of inner dial cone 130, holding inner dial cone 130 stationary as outer dial cone 105 rotates. Since locking ring 120 is coupled to inner dial cone 130 by means of springs 122 and balls 123, locking ring 120 will also remain stationary at this time.

On the other hand, locking ring 112 will rotate with outer dial cone 105. That is, springs 114 hold balls 115 in serrations 109 in portion 108 of outer dial cone 105 so that locking ring 112 is caused to rotate with outer dial cone 105. Rotating outer dial 110 on base plate 80 brings slot 117 into alignment with slot 124 and into alignment with lock sleeve key 75. This position is shown in FIGS. 13 and 14 and rotation of knob 23 is now permitted. That is, as knob 23 is rotated, rotating cam housing 37, pin 55, extending into one of slots 71 or 72 in lock sleeve 71, will cause axially inward movement of lock sleeve 70. Since slots 117 and 124 in lock rings 112 and 120, respectively, are now aligned with lock sleeve key 75, lock sleeve key 75 moves forwardly to the position shown in FIG. 13, entering slots 117 and 124. This action permits rotation of knob 23, cam housing 37, and shaft 18, thereby activating latch mechanism 13 and retracting tongue 17.

Bridge member 76 connected to lock sleeve 70 is designed to prevent the recession of lock pin 103 when knob 23 is slightly turned, whether assembly 10 is in a locked to unlocked position. That is, when lock pin 55 causes forward movement of lock sleeve 70, bridge member 76 moves into position beneath lock pin 103, as shown in FIG. 13, and eventually into hole 96 in base plate 80. With bridge member 76 in this position, lock pin 103 cannot be retracted and remains engaged with serrations 107 in portion 106 of outer dial cone 105. This eliminates the accidental changing of the combination. Normally, lock pin 103 is under spring pressure, with spring 102 forcing the upper end thereof to mesh with serrations 107 of outer dial cone 105. This achieves an indexing function and a clicking sound during rotation of outer dial cone 105, as explained previously.

To change the combination, it is first necessary to know the existing combination. That is, when locking rings 112 and 120 are in the positions shown in FIG. 14, all of holes 29, 90, 118, and 125 are aligned. At this time pin-key 160 can be inserted through hole 29 in internal rosette 26, which permits key 160 to travel through internal rosette 26, through hole 90 in base plate 80, and to come to rest within holes 118 and 125 in locking rings 112 and 120, respectively. With pin-key 160 in this position, locking rings 112 and 120 are prevented from rotating. Thus, outer dial cone 105 can be rotated clockwise and, in so doing, will rotate inner dial cone 130, as described previously, to whatever new number is desired. Then, outer dial cone 105 can be rotated counterclockwise to whatever new number is desired for it, inner dial cone 130 remaining stationary at this time. During the rotation of outer and inner dial cones 105 and 130, respectively, locking rings 112 and 120 are held stationary, keeping slots 117 and 124, respectively therein, aligned with lock sleeve key 75. In addition, springs 114 and 122 compress, permitting balls 115 and 123, respectively, to slip along serrations 109 and 131, respectively, so that dial cones 105 and 130 rotate independently of locking rings 112 and 120. Now, extracting pin-key 160, the lock has been newly programed and continued rotation of outer dial cone 105 will manipulate inner dial cone 130 and locking rings 112 and 120, as explained previously.

It can therefore be seen that according to the present invention, there is provided a combined knob and permutation lock assembly 10 for operating door latch mechanism 13 which is designed to fit conventional swinging doors to provide maximum security without the need of a key which could be lost, stolen, or duplicated. With assembly 10, there is no need to prepare door 12 beyond the normally drilled openings for conventional hardware. Once installed, external door knob 23 has positioned adjacent thereto a coaxial dial cone 105, which may be rotated first in one direction and then in another direction to dial a desired combination. With sixty numbers on dial cones 105 and 130, 3,540 combinations are available. Furthermore, assembly 10 permits an operator, when the proper combination is known, to change within a matter of seconds from one combination to another, thereby eliminating the expensive re-keying process normally associated with key-activated locks.

When assembly 10 is locked and knob 23 is attempted to be turned, tongue 17 will not retract. Also incorporated is a clutch device including clutch disc 42 which permits knob 23 to turn in either direction when the door is locked and excessive force is applied thereto, thus preventing damage to assembly 10.

Assembly 10 offers outstanding visibility of the characters on dials 105 and 130, with dial cone 105 controlling hidden dial 130. Thus, assembly 10 can be programed to open very rapidly with the use of one hand rotating outer dial 105 in one direction, which rotates inner dial cone 130 which is visible through magnifying lens 156. Then, by rotating outer dial cone 105 in the other direction until the proper number is aligned with mark 110, assembly 10 is unlocked. Locking assembly 10 is achieved by simply rotating through an angle of 90° dial plunger 31 mounted within internal knob 24.

While the invention has been described with respect to a preferred physical embodiment constructed in accordance therewith, it will be apparent to those skilled in the art that various modifications and improvements may be made without departing from the scope and spirit of the invention. For example, any number of serrations may be utilized in dial cones 105 and 130 to adjust the different number of combinations available. Furthermore, by adding a third dial cone, which would be independently rotatable and control an independently rotatable locking ring, the number of combinations could be increased. With sixty numbers on three dials, there would be 216,000 different combinations. Alternatively, by placing on each dial the alphabet, rather than numbers, there would be permitted the spelling of any three-letter word with just under 20,000 various combinations. Accordingly, it is to be understood that the invention is not to be limited by the specific illustrative embodiment, but only by the scope of the appended claims.

I claim:

1. A combination knob and permutation lock assembly adapted to be mounted in a door for controlling a door latch comprising:

coaxial external and internal knobs mounted for rotation on opposite sides of said door;

shaft means extending coaxially between said door knobs for rotation therewith, said shaft means engaging and activating said door latch upon rotation thereof by either of said knobs;

sleeve means mounted on said shaft means for axial movement only relative to said assembly, said sleeve means having a diagonal slot therein and including a radially extending key;

a pin mounted within said shaft means and being movable axially relative thereto, perpendicular to the axis of said shaft means, into and out of said slot in said sleeve means, said shaft means being rotatable to activate said door latch independently of said sleeve means when said pin is withdrawn from said slot in said sleeve means, rotation of said shaft means causing axial movement of said sleeve means when said pin is extending into said slot therein;

means for biasing said pin out of said slot in said sleeve means;

manually operable cam means for moving said pin into said slot in said sleeve means to thereby lock said door;

first and second locking rings mounted coaxially with said shaft means, said locking rings having first and second slot means therein, respectively, alignable with said sleeve means key, said locking rings preventing axial movement of said sleeve means and activation of said door latch except when both said first and second slot means are aligned with said sleeve means key; and means mounted coaxially with and adjacent said external door knob and operatively connected to said first and second locking rings for independently moving said locking rings to align said first and second slot means with said sleeve means key so as to unlock said assembly.

2. An assembly according to claim 1 wherein said first and second locking rings are coplanar, said first and second slot means defining a continuous slot when aligned.

3. An assembly according to claim 1 wherein said shaft means comprises:

an elongate, generally cylindrical, hollow section having a transverse hole therein, said pin being mounted for axial movement in said hole in said hollow section.

4. An assembly according to claim 3 wherein said pin has a head at the end thereof farthest from said hole in said hollow section and wherein said pin biasing means comprises:

a spring surrounding said pin and extending between said head and the inner wall of said hollow section.

5. An assembly according to claim 4 wherein said cam means comprises:

a slide member mounted within said hollow section of said shaft means, said slide member having a cam surface, said head of said pin resting on said cam surface of said slide member, said slide member being axially movable in said hollow section of said shaft means, said cam surface of said slide member moving said pin through said hole into and out of said slot in said sleeve means as said slide member moves axially; and second shaft means extending through said hollow section of said first-mentioned shaft means and connected between said slide member and said internal knob for manually moving said slide member from a position adjacent said internal knob.

6. An assembly according to claim 5 wherein said cam means further comprises:

third shaft means mounted for rotation in said internal knob, one end of said third shaft means contacting one end of said second shaft means;

a dial connected to the other end of said third shaft means and positioned approximately coplanar with the external end of said internal knob; and cam means operatively connected to said third shaft means for causing axial movement of said third shaft means upon rotation thereof, whereby rotation of said dial rotates said third shaft means, moving said third shaft means, said second shaft means, and said slide member axially, causing locking and unlocking of said assembly.

7. An assembly according to claim 1 wherein said sleeve means has first and second intersecting, oppositely extending, diagonal slots therein, said cam means moving said pin into the intersection of said slots in said sleeve means, whereby rotation of said shaft means in either direction causes axial movement of said sleeve means along said shaft means.

8. An assembly according to claim 7 wherein said first and second locking rings are coplanar, said first and second slot means defining a continuous slot when aligned, said sleeve means key entering said continuous slot when said first and second slot means are aligned with said sleeve means key, movement of said sleeve means being prevented when either said first of said second slot means are misaligned with said sleeve means key.

9. An assembly according to claim 1 wherein said means for moving said locking rings comprises:

outer and inner concentric dials mounted adjacent said external door knob and having indicia on the outwardly directed faces thereof;

means interconnecting said dials for rotation of said inner dial with said outer dial in a first rotary direction only;

means operatively connecting said first locking ring to said outer dial; and means operatively connecting said second locking ring to said inner dial for rotation therewith, said outer dial being rotatable in said first direction, thereby rotating said inner dial and said first and second locking rings, to align said second slot means in said second locking ring with said sleeve means key, said outer dial being rotatable in an opposite rotary direction, thereby rotating said first locking ring, to align said first slot means in said first locking ring with said second slot means and said sleeve means key, said inner dial and said second locking ring remaining stationary during rotation of said outer dial and said first locking ring in said opposite direction.

10. An assembly according to claim 9 wherein each of said dials has an internally serrated surface and wherein said means connecting said locking rings to said dials comprises:

spring-biased ball bearings mounted in the outer circumferences of said locking rings, said balls engaging said serrated surfaces of said dials.

11. An assembly according to claim 10 wherein said locking rings have axially directed holes therein, said holes being aligned when said first and second slot means are aligned, and further comprising:

a pin extendable through said aligned holes in said locking rings for holding said locking rings stationary during rotation of said outer and inner concentric dials to permit changing of the combination of said assembly.

12. An assembly according to claim 10 wherein said means interconnecting said dials comprises:

a ratchet mechanism including a spring-biased pawl connected to said inner dial, said pawl engaging said internally serrated surface of said outer dial, said ratchet mechanism forcing said inner dial to rotate with said outer dial when said outer dial is rotated in said first rotary direction, said ratchet mechanism causing slipping between said pawl and said internally serrated surface of said outer dial when said outer dial is rotated in said opposite direction.

13. An assembly according to claim 1 further comprising:

friction clutch means connecting said external knob to said shaft means, said clutch means permitting independent rotation of said external knob and said shaft means when said assembly is locked.

14. An assembly according to claim 13 wherein said clutch means comprises:

a serrated face on said shaft means;

a clutch disc having a serrated face which mates with said shaft means serrated face;

means for connecting said clutch disc to said external knob for rotation therewith and limited axial movement relative thereto; and means connected to said shaft means for biasing said clutch disc serrated face into contact with said shaft means serrated face, said biasing means normally exerting a sufficient force to prevent slippage between said serrated faces, excessive force on said external knob causing slippage of said serrate faces and rotation of said external knob independently of said shaft means.

15. A combination knob and permutation lock assembly adapted to be mounted in a door for controlling a door latch comprising:

coaxial external and internal knobs mounted for rotation on opposite sides of said door;

shaft means extending coaxially between said door knobs for rotation therewith, said shaft means engaging and activating said door latch upon rotation thereof by either of said knobs;

sleeve means mounted on said shaft means for axial movement only relative to said assembly as said shaft means is rotated by either said external or said internal knob, said sleeve means including a radially extending key;

first and second coplanar locking rings mounted coaxially with said shaft means, said locking rings having first and second slot means therein, respectively, alignable with each other to define a continuous slot which is alignable with said sleeve means key, said locking rings preventing axial movement of said sleeve means and activation of said door latch except when both said first and second slot means are aligned with said sleeve means key; and means mounted coaxially with and adjacent said external door knob and operatively connected to said first and second locking rings for independently moving said locking rings to align said first and second slot means with said sleeve means key so as to unlock said assembly.

16. An assembly according to claim 15 wherein said means for moving said locking rings comprises:

outer and inner concentric dials mounted adjacent said external door knob and having indicia on the outwardly directed faces thereof;

means interconnecting said dials for rotation of said inner dial with said outer dial in a first rotary direction only;

means operatively connecting said first locking ring to said outer dial; and means operatively connecting said second locking ring to said inner dial for rotation therewith, said outer dial being rotatable in said first direction, thereby rotating said inner dial and said first and second locking rings, to align said second slot means in said second locking ring with said sleeve means key, said outer dial being rotatable in an opposite rotary direction, thereby rotating said first locking ring, to align said first slot means in said first locking ring with said second slot means and said sleeve means key, said inner dial and said second locking ring remaining stationary during rotation of said outer dial and said first locking ring in said opposite direction.

17. An assembly according to claim 16 wherein each of said dials has an internally serrated surface and wherein said means connecting said locking rings to said dials comprises:

spring-biased ball bearings mounted in the outer circumferences of said locking rings, said balls engaging said serrated surfaces of said dials.

18. An assembly according to claim 17 wherein said means interconnecting said dials comprises:

a ratchet mechanism including a spring-biased pawl connected to said inner dial, said pawl engaging said internally serrated surface of said outer dial, said ratchet mechanism forcing said inner dial to rotate with said outer dial when said outer dial is rotated in said first rotary direction, said ratchet mechanism causing slipping between said pawl and said internally serrated surface of said outer dial when said outer dial is rotated in said opposite direction.

19. An assembly according to claim 16 further comprising:

a face plate mounted concentrically with said dials, adjacent said external door knob, said inner dial being hidden behind said face plate, said face plate having a window therein for viewing said indicia on said inner dial therethrough.

* * * * *

UNITED STATES PATENT OFFICE

CERTIFICATE OF CORRECTION

Patent No. 3,952,562 Dated April 27, 1976

Inventor(s) A. Ray Snow

It is certified that error appears in the above-identified patent and that said Letters Patent are hereby corrected as shown below:

Column 1, line 67, "was" should read -- has --.

Column 8, line 13, "one" should read -- cone --.

Column 8, line 56, after "tends" insert -- into --.

Column 10, line 62, after "dial", second occurrence, insert -- cone 105 until the programmed number comes into alignment with mark --.

Signed and Sealed this

Sixteenth Day of November 1976

[SEAL]

*Attest:*

RUTH C. MASON
*Attesting Officer*

C. MARSHALL DANN
*Commissioner of Patents and Trademarks*